United States Patent [19]

Connors et al.

[11] Patent Number: 5,004,103

[45] Date of Patent: Apr. 2, 1991

[54] TOOL STORAGE BOX

[75] Inventors: Peter J. Connors, Radnor, Pa.; Sean Scully, Nanuete; Frank Bria, West Nyack, both of N.Y.; John ReFalo, III, Basking Ridge, N.J.

[73] Assignee: Remcon Plastics, Inc., Conshohocken, Pa.

[21] Appl. No.: 405,025

[22] Filed: Sep. 11, 1989

[51] Int. Cl.[5] ..... B65B 85/20

[52] U.S. Cl. ..... 206/372; 206/563; 206/379; 211/69; 211/70.6

[58] Field of Search ..... 206/562, 563, 372, 373, 206/375, 376, 377, 379, 380, 382, 383; 211/69, 70.6

[56] References Cited

U.S. PATENT DOCUMENTS

| | | | |
|---|---|---|---|
| 921,149 | 5/1909 | Norwood | 206/372 X |
| 3,056,525 | 10/1962 | Deinert | 206/508 X |
| 3,506,113 | 4/1970 | Garnier | 206/379 X |
| 3,532,221 | 10/1970 | Kaluhiokalani et al. | 211/70.6 |
| 3,545,606 | 12/1970 | Bennett et al. | 206/383 X |
| 3,604,565 | 9/1971 | Freeman | 211/69 X |
| 4,489,994 | 12/1984 | Williams | 211/69 X |
| 4,503,972 | 3/1985 | Nelligan et al. | 206/379 |
| 4,768,652 | 9/1988 | Fallon | 206/379 X |
| 4,858,302 | 8/1989 | Stribiak | 211/69 X |

*Primary Examiner*—Paul T. Sewell
*Assistant Examiner*—Jacob K. Ackun, Jr.
*Attorney, Agent, or Firm*—Antonelli, Terry, Stout & Kraus

[57] ABSTRACT

A storage and tote box for tools such as, for example, punches and dies for the production of pharmaceutical tablets and caplets which includes a container for accommodating a plurality of tools with a tray being removably accommodated in the container for suspending the respective tools therein. A support is provided on the upper surface of the tray for supporting an upper portion of the respective tools above the upper surface of the tray, with the positional locking arrangement being provided on the tray for locking the respective tools in position relative to the tray. A lid is provided for covering an open end of the container, with the lid being provided with a recess for accommodating a bottom of a further container thereby permitting stacking of a plurality of individual containers.

18 Claims, 3 Drawing Sheets

FIG. 3.
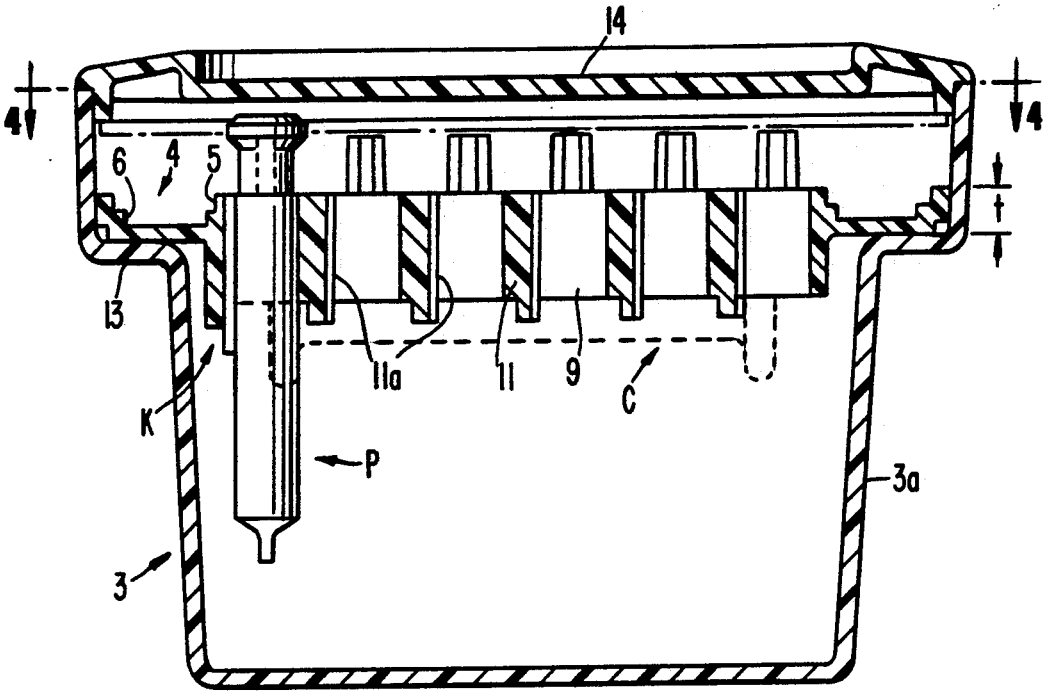
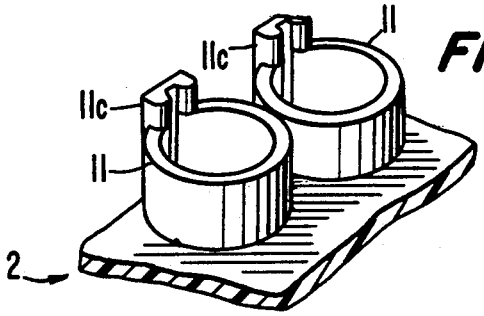
FIG. 5.
FIG. 4.
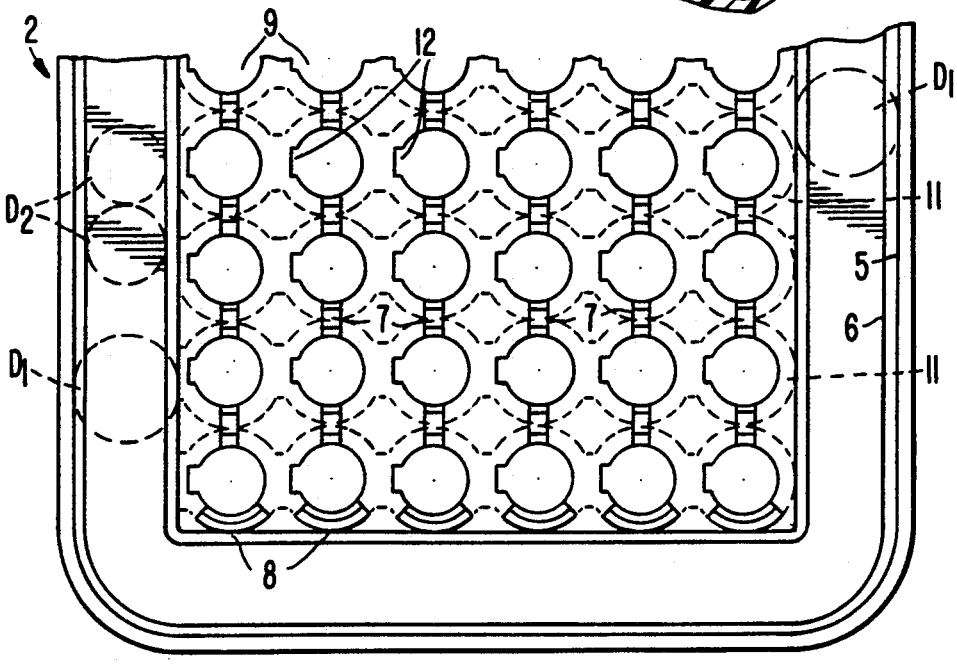

TOOL STORAGE BOX

BACKGROUND OF THE INVENTION

The present invention relates to a storage box and, more particularly to a tool storage and tote box arrangement for accommodating tools such as punches and dies used, for example, in the production of pharmaceutical tablets and caplets.

Storage boxes of the aforementioned type have been proposed wherein dies are stored in a bottom of a container, with punches or the like being suspended from a tray adapted to be removably accommodated in the container.

In the proposed storage boxes, the removable tray is in the form of a grid work which supports the tools or punches by suspending the punches in the container by way of the heads provided on the respective tools. The grid work includes a plurality of square openings and is constructed so as to prevent the tools from swaying and coming in contact with each other. In use, each punch is inserted in the square opening of the grid work of the tray such that a key normally provided on the punch passes through a corner of the square for clearance purposes, with the key extending through the square opening and projecting on an opposite side of the tray.

One disadvantage of the above proposed storage box arrangement resides in the fact that if the tool or punch somehow turns while suspended in the tray, the key becomes trapped or lodged against the undersurface of the tray and the user must then rotate the tool or punch while pulling the same up slightly until the key reaches the proper position in the square opening so that the tool can be freely removed.

Another disadvantage of the above-proposed storage box construction resides in the fact that the dies are generally stored in the bottom of the container and access to such dies can only be gained by removing the storage tray which leads to yet a further disadvantage in that the lifted tray cannot be placed on any surface since the tools or punches could be ejected from the tray or, depending upon the number of tools in the tray, the tray would be unstable and the individual tools may collide with one another causing damage to the respective tools.

A still further disadvantage of the above-proposed storage box construction resides in the fact that the heads of the tools or punches rest flush on the upper surface of the tray thereby making it difficult to grasp or manipulate the tool or punch to remove the same from the tray.

In, for example, U.S. Pat. No. 4,503,972, a microdrill package is proposed for enabling a resilient suspended mounting of delicate drill bodies in a removable tray in order to eliminate or minimize breakage of the delicate drill bodies during transport and handling. This proposed arrangement suffers from the same disadvantages noted hereinabove and, in particular, once the tray is removed from the container, it cannot be placed on any surface without the suspended delicate drill bits being displaced from the tray or possibly subjected to damage.

In, for example, U.S. Pat. No. 4,489,994, yet another punch and die storage arrangement is proposed wherein the storage box includes a plurality of horizontal nests for horizontally storing punches, with horizontally extending drawers being provided for accommodating dies matching the stored punches. Additionally, a plurality of vertically oriented punch nests may be mounted on doors of the storage box which, when opened, provide access to the horizontally stored punches.

A disadvantage to the last proposed arrangement resides in the fact that by virtue of the horizontal disposition of the punches, access to the individual punches for the purpose of removing the same from the associated nest is difficult because of limited clearance between adjacent punches as well as between the punches and adjacent box structure.

DES275,822 and 2,889,985, for example, contain design proposals for tool storage or organizes arrangement but offer no insight in avoiding the above-noted disadvantages encountered in the prior art.

The aim underlying the present invention essentially resides in providing a tool storage and tote box arrangement for storing and carrying, for example, punches and dies used in the production of pharmaceutical tablets and caplets, which avoids, by simple means, shortcomings and disadvantages encountered in the prior art.

In accordance with advantageous features of the present invention, a storage and tote box for punches and dies used in, for example, the manufacturing of pharmaceutical tablets and caplets is provided wherein both the punches and dies are stored by a removable tray, with the punches being removably suspended in a tray removably mounted in a box or container. The tray is provided with a means for facilitating a removal of the respective punches, a means for positively locking the punches in the tray, and a means for accommodating the dies associated with the respective punches.

By virtue of the above-noted features of the present invention, the individual punches are suspended in such a manner that they do not contact each other or a bottom or side wall of the container or box thereby preventing any scratching, nicking, or denting of the punches.

Moreover, by virtue of the disposition of the corresponding dies on the tray, an easy access to the dies is provided without requiring a removal of the tray to gain access to such dies.

In accordance with further advantageous features of the present invention, the tray is provided with a plurality of round holes for accommodating the respective punches, with the holes being spaced from one another to provide sufficient clearance between the punches so as to prevent the individual punches from contacting each other during, for example, transporting of the box or a removed tray.

Moreover, the provision of the positional locking means in accordance with the present invention insures that the punches remain oriented relative to the tray exactly in the insert position thereby facilitating subsequent removal of the individual punches.

The positional locking means may, in accordance with the present invention, include a notched portion in the respective openings provided in the tray for accommodating a key portion provided on the respective punches. Moreover, the notch may have an axial length corresponding to an axial length of the key or may have a sufficient length for insuring a non-rotatable mounting of the punch relative to the tray.

Additionally, in accordance with the present invention, a guide or rail means is provided about a periphery of the grid work formed in the tray so as to accommodate the dies for the associated punches on an upper surface of the tray thereby providing access to the dies without requiring a removal of the tray from the container.

Advantageously, according to the present invention, means are provided in the vicinity of each of the through-holes provided in the removable tray for suspending a head of the respective punches at a predetermined spacing from the upper surface of the tray thereby facilitating a grasping of the individual punches to remove the same from the tray.

To insure the suspension of the individual punches in the tray while preventing the punches from striking each other during insertion or removal of the individual punches, during transporting of the storage box or removal of the tray from the container, according to still further features of the present invention, guide means are provided in a vicinity of each of the through holes in the tray for guiding at least a portion of an axial length of the punches when the punches are suspended in the tray.

Advantageously, the guide means for the punches may take the form of a single projecting portion preferably having a contour of the punches or may be fashioned as an extension of the through hole projecting beyond a lower surface of the tray.

In accordance with still further features of the present invention, the notches forming the positional locking means may be fashioned in the single projecting portion or extension of the through hole forming the guide means.

The notches forming the positional locking means may, in accordance with the present invention, have an axial length corresponding to the single projection portion or an extension of the through hole forming the guide means or may be formed as a projecting portion extending beyond an end of the single projecting portion of extension of the through hole.

Preferably, according to the present invention, the means for suspending the head of the respective punches includes a projecting portion extending upwardly from a top surface of the tray and disposed in a vicinity of the respective through holes, with the respective projecting portions including chamfered or beveled surface portions engageable with a beveled portion of the head of the punches.

Accordingly, it is an object of the present invention to provide a tool storage and tote box which is simple in construction and relatively inexpensive to manufacture.

Yet another object of the present invention resides in providing a tool storage and tote box which enables a suspension of tools in a tray of the storage and tote box in such a manner that the respective tools may be individually grasped for an easy removal.

Yet another object of the present invention resides in providing a tool storage and tote box which eliminates the need for removing a tray supporting the tools to provide access to dies or the like associated with the respective tools.

The above and other objects, features, and advantages of the present invention will become more apparent from the following description when taken in connection with the accompanying drawings which show, for the purpose of illustration only, one embodiment in accordance with the present invention.

BRIEF DESCRIPTION OF THE DRAWINGS

FIG. 3 is a cross-sectional view taken along line 3—3 in FIG. 2;

FIG. 4 is a cross-sectional view taken along line 4—4 in FIG. 3; and FIG. 5 is a perspective detail view of a portion of the underside of the removable tray of the tool storage and tote box constructed in accordance with the present invention.

DETAILED DESCRIPTION

Figure 1:
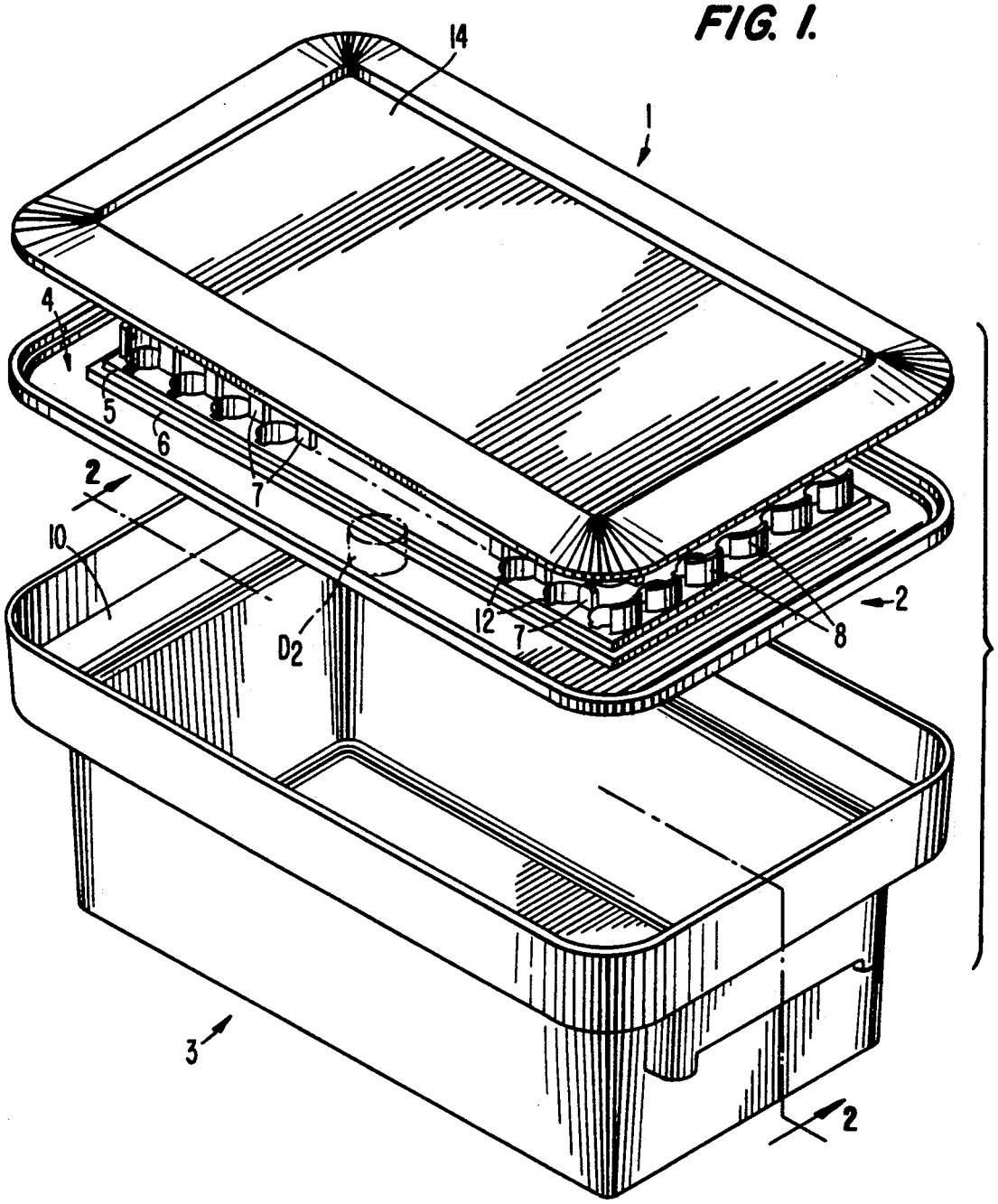
FIG. 1 is an exploded perspective view of a tool storage and tote box constructed in accordance with the present invention.
Figure 2:
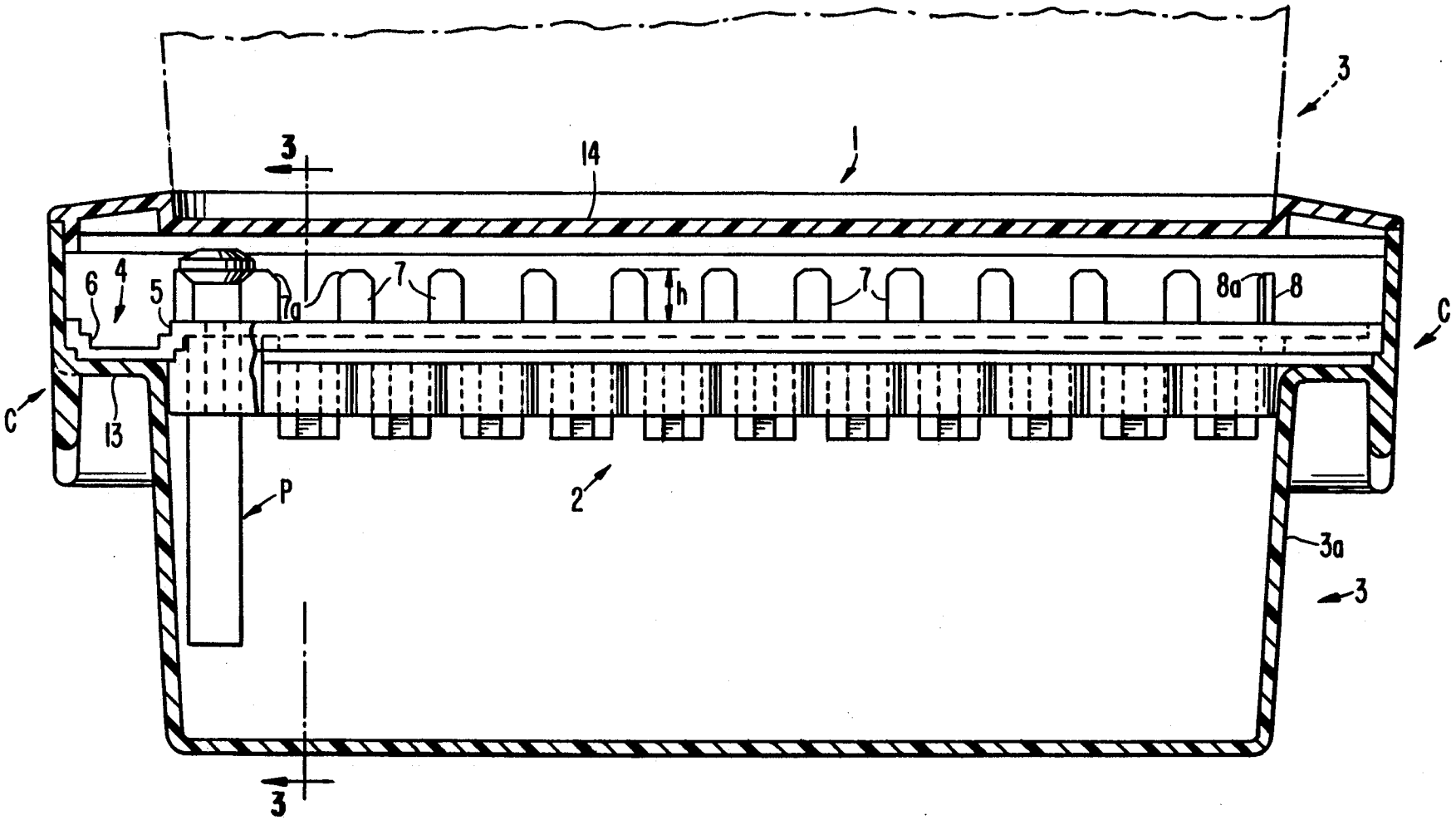
FIG. 2 is a cross-sectional view taken along line 2—2 in FIG. 1.

Referring now to the drawings wherein like reference numerals are used throughout the various views to designate like parts and, more particularly, to FIG. 1, according to this figure, a tool storage and tote box for tools such as, for example, punches and dies used in the production of pharmaceutical tables and caplets, includes a substantially rectangular container generally designated by the reference numeral 3 for accommodating a removable tray generally designated by the reference numeral 2 with a lid or cover generally designated by the reference numeral 1 being provided for closing an open end of the container 3. The lid or cover 1 is provided with a recessed portion 14 dimensioned so as to accommodate a bottom of another container 3 so as to permit a stacking of the storage or tote boxes as schematically shown in FIG. 2.

The container 3 includes handle or carry portions generally designated by the reference character C provided at respective sides thereof for facilitating a carrying and handling of the storage and tote box. A flange or lip portion 13 extends about a periphery of a lower portion 3*a* of the container 3 so as to form a ledge or shelf. The lower portion 3*a* of the container 3 is dimensioned so as to permit a nesting of the containers 3 during storage or the like.

The tray 2, as shown most clearly in FIGS. 3 and 4, includes a plurality of through holes 9 arranged in a grid work pattern, with the through holes 9 being spaced from each other a sufficient amount so as to permit a grasping of a head portion generally designated by the reference character H of the respective punches generally designated by the reference character P. A plurality of projection means 7 extending upwardly from a top surface of the tray 2 are disposed on diametrically opposite sides of the respective through holes 9. The projection means have a predetermined height h (FIG. 2) sufficient to enable the fingers of a user to grasp the head portion H of the respective punches P to facilitate removal of the punches P from the tray 2.

A plurality of end projection means 8 are provided at opposite ends of the tray 2 in a vicinity of the through holes 9, with the projection means 8 having a semi-circular configuration or configuration corresponding to an outer surface of the respective punches P. Each of the projection means 7, 8 are provided with chamfered or beveled edges 7*a*, 8*a* for accommodating the head portions H of the respective punches P.

Each of the through holes 9 includes a positional locking means for maintaining the punches P in the inserted position in the tray by preventing rotation of the punches P relative to the tray 2. More particularly, each through hole 9 is provided with a notch 12 for accommodating a key generally designated by the reference character K (FIG. 3) provided on the respective punches P. The notches 12 have an axial length at least equal to a thickness t (FIG. 3) of the tray 2.

Guide means are provided for preventing the punches suspended in the through holes 9 of the tray 2 from contacting each other during insertion and removal from the tray, transporting of the tray, etc. For this purpose, as shown most clearly in FIGS. 3, 4 and 5, cylindrical guide means are provided at each of the through holes 9 and are fashioned as cylindrical projections 11 extending from a bottom surface of the tray 2, with each of the cylindrical projections 11 including a through hole concentrically aligned with the respective through holes 9 whereby the respective punches P are suspended by adjacent projection means 7 or 7 and 8 and extends through the through holes 9 so as to be guided by the cylindrical guide means along an axial length of the respective punches P so as to maintain the respective punches P substantially perpendicular to the tray 2 and parallel to adjacent punches P regardless of the angular orientation of the tray 2. The cylindrical projections 11 also include a notch 11*a* forming an extension of the notch 12 provided in the respective through holes 9.

To further insure the positional locking of the respective punches P and the tray 2, as shown in FIG. 5, the cylindrical extensions 11 may further include a further extension portion 11*c* extending from a free end of the respective cylindrical extensions 11, with the further extension portion 11*c* forming a further extension of the notch 12, 11*a* thereby accommodating a greater axial length of the key K of the punches P.

Guide or rail means generally designated by the reference numeral 4 are provided around the periphery of the grid work of the tray 2 for accommodating dies $D_1$, $D_2$ (FIGS. 1 and 4) associated with the respective punches P. The guide or rail means 4 is fashioned as a stepped recess including spaced guide walls 5, 6 for defining guide tracks to accommodate dies of differing diameters on the upper surface of the tray 2 thereby dispensing with the need to remove the tray 2 from the container 3 to gain access to the dies $D_1$, $D_2$. While only two guide tracks are illustrated in the drawings, it is understood that further guide tracks could be provided, with a spacing between the guide walls being determined by the diameter of the respective dies $D_1$, $D_2$.

As shown in FIGS. 2 and 3, in use, the punches P are inserted in the through holes 9, with the heads thereof supported by adjacent projection means 7 or 7, 8 and the body of the punches P extending through the guide means formed by the cylindrical extensions 11. The key K of the respective punches P is accommodated in the notches 12, 11*a* and notch extensions provided in the further extension portions 11*c*. The dies $D_1$, $D_2$ are disposed in the guide or rail means 4 disposed about the periphery of the grid work of the tray 2 and the entire tray is suspended on an upper surface of the flange 13 forming the shelf or ledge of the container 3.

The container 3, lid 1 and tray 2 are preferably fashioned of a plastic material by a conventional molding technique so as to minimize the cost of manufacturing while nevertheless providing a durable, lightweight tool storage and tote box.

While I have shown and described only one embodiment in accordance with the present invention, it is understood that the same is not limited thereto by is susceptible to numerous changes and modifications as known to one of ordinary skill in the art, and I therefore do not wish to be limited to the details shown and described herein, but intend to cover all such modifications as are encompassed by the scope of the appended claims.

We claim:

1. A storage and tote box for tools, the storage and tote box comprising:

container means for accommodating a plurality of tools, tray means adapted to be disposed in said container means for suspending the respective tools in the said container means, a plurality of through hole means provided in said tray means for accommodating at least a body portion of the respective tools, means provided on an upper surface of the tray means for supporting an upper portion of the respective tools above an upper surface of the tray means, means provided in said tray means for positionally locking the respective tools relative to said tray means, and means provided on said tray means for preventing said tools from contacting each other in a suspended position including an extension means provided on a lower surface of the tray means at each of said through hole means for engaging a portion of the body of the respective tools, and wherein said extension means includes mean for positionally locking the respective tools relative to the tray means.

2. A storage and tote box according to claim 1, wherein said plurality of through hole means are arranged in a grid pattern, and wherein said means provided in said tray means for positionally locking is disposed in each of said through hole means.

3. A storage and tote box according to claim 2, wherein said means for supporting an upper portion of the respective tools includes projection means disposed on diametrically opposite sides of the respective through hole means, the upper portion of the respective tools resting on an upper surface of the projection means when said tools are suspended by said tray means.

4. A storage and tote box according to claim 3, wherein said means for positionally locking said tools provided in said tray means and said means of said extension means for positionally locking said tools includes a notch means for accommodating a key means provided on the respective tools.

5. A storage and tote box according to claim 4, wherein ledge means are provided on said container means for suspending the tray means in said container means.

6. A storage and tote box according to claim 5, further comprising rail means disposed about a periphery of the grid pattern of through hole means for accommodating die means for the respective tools.

7. A storage and tote box according to claim 6, further comprising lid means for covering an open end of said container means, said lid means including means for accommodating a further container means to facilitate a stacking of the plurality of container means.

8. A storage and tote box according to claim 7, further comprising projection means extending from free ends of the extension means to longitudinally extend the notch means of said extension means accommodating the key means of the respective punches.

9. A storage and tote box according to claim 8, wherein said tools includes include punch means used in a production of pharmaceutical tablets and caplets.

10. A storage and tote box according to claim 1, wherein said means for supporting an upper portion of the respective tools include projection means disposed on diametrically opposite sides of the respective through hole means, the upper portion of the respective tools resting on an upper surface of the projection means whereby said tools are suspended by said tray means.

11. A storage and tote box according to claim 1, wherein said means provided in said tray means for positionally locking said tools includes notch means for accommodating key means provided on the respective tools.

12. A storage and tote box according to claim 1, further comprising ledge means provided on said container means for suspending the tray means in said container means.

13. A storage and tote box according to claim 1, further comprising rail means disposed about a periphery of the tray means for accommodating die means for the respective tools.

14. A storage and tote box according to claim 1, further comprising lid means for covering an open end of said container means, said lid means including means for accommodating a further container means to facilitate a stacking of a plurality of container means.

15. A storage and tote box according to claim 1, wherein said tray means and container means are fashioned of a plastic material.

16. A storage and tote box according to claim 1, wherein said tools include punch means for producing pharmaceutical tablets and caplets.

17. A storage and tote box according to claim 1, wherein said means of said extension means for positionally locking includes notch means for accommodating key means provided on the respective tools.

18. A storage and tote box according to claim 1, further comprising projection means extending from free ends of the extension means for longitudinally extending said means of said extension means for positionally locking the respective tools relative to the tray means.

* * * * *